United States Patent [19]

Jackson

[11] 4,334,532

[45] Jun. 15, 1982

[54] VALVES AND BREATHING APPARATUS INCORPORATING SUCH VALVES

[75] Inventor: Peter J. Jackson, Dorking, England

[73] Assignee: Chubb Panorama Limited, Bognor Regis, England

[21] Appl. No.: 161,624

[22] Filed: Jun. 20, 1980

[30] Foreign Application Priority Data

Jun. 21, 1979 [GB] United Kingdom ..... 7921698
Sep. 26, 1979 [GB] United Kingdom ..... 7933304

[51] Int. Cl.[3] ..... A62B 7/04

[52] U.S. Cl. ..... 128/204.26; 128/205.24; 137/491; 137/82; 251/45

[58] Field of Search ..... 128/204.26, 204.27; 137/491, 489, 82; 251/111, 113, 115, 45; 92/23

[56] References Cited

U.S. PATENT DOCUMENTS

| | | | |
|---|---|---|---|
| 2,406,888 | 9/1946 | Meidenbauer, Jr. | 128/205.22 |
| 2,685,288 | 8/1954 | Fields et al. | 128/204.26 |
| 2,803,258 | 8/1957 | Dyson | 137/92 |
| 2,886,049 | 5/1959 | Holm et al. | 128/204.26 |
| 3,285,261 | 11/1966 | Chaney | 128/204.26 |
| 3,467,136 | 9/1969 | LeMasson | 137/489 |
| 4,219,017 | 8/1980 | Shamlian et al. | 128/204.26 |

FOREIGN PATENT DOCUMENTS

| | | | |
|---|---|---|---|
| 1949560 | 6/1970 | Fed. Rep. of Germany . | |
| 2643561 | 3/1978 | Fed. Rep. of Germany . | |
| 645589 | 9/1962 | Italy | 128/204.26 |
| 847754 | 9/1960 | United Kingdom | 128/204.26 |
| 885353 | 12/1961 | United Kingdom . | |
| 1407624 | 9/1975 | United Kingdom . | |
| 1430383 | 3/1976 | United Kingdom . | |
| 1495642 | 12/1977 | United Kingdom . | |
| 1495911 | 12/1977 | United Kingdom . | |
| 1569875 | 6/1980 | United Kingdom . | |

*Primary Examiner*—Henry J. Recla
*Attorney, Agent, or Firm*—Pollock, VandeSande and Priddy

[57] ABSTRACT

A valve, notably for use as a demand valve in breathing apparatus, has a pressure-responsive diaphragm coupled to a separate control member which lies in the path of a jet of gas which vents from a control chamber through an orifice, gas being continuously supplied to the control chamber. Deflection of the diaphragm in response to pressure changes in a second chamber caused by inhalation and exhalation of the user of the apparatus pivots the control member towards or away from the jet orifice to control the rate of venting from the control chamber and thereby vary the pressure within the control chamber. Flow of gas through the valve to the user of the apparatus is controlled by a flexible disc which in turn responds to the pressure in the control chamber. By employing a separate diaphragm and control member the former can be optimized for pressure-response while the latter can be optimized for valve-regulation by interaction with the gas jet from the control chamber.

11 Claims, 7 Drawing Figures

VALVES AND BREATHING APPARATUS INCORPORATING SUCH VALVES

This invention relates to valves, and is concerned especially, though not exclusively, with demand valves for breathing apparatus.

The invention relates more particularly to valves of the kind in which gas flow is regulated in accordance with pressure within a control chamber, gas being supplied continuously to the control chamber and vented therefrom through a jet orifice in dependence upon deflection of a pressure-responsive member whereby the pressure within the control chamber, and accordingly flow of gas through the valve, is dependent upon such deflection. Valves of this kind (referred to hereafter as "of the kind specified") are described in United Kingdom Patent Application No. 1569875 and U.S. Pat. No. 3,467,136, as used in breathing apparatus for regulating flow of gas in accordance with breathing demands. With these earlier forms of demand valve, a pressure-responsive diaphragm is located in the path of the jet of gas vented from the control chamber and responds to pressure changes caused by inhalation and exhalation of the person using the breathing apparatus to be deflected towards or away from the jet orifice according to the sense in which gas-flow through the valve is to be changed.

Although forms of demand valve such as disclosed in the above-identified references have been found to function satisfactorily, and (as illustrated in particular by the form described in U.K. Patent Application No. 1569875) can have an especially compact and convenient construction, they do present certain practical problems. In particular the characteristics of the diaphragm and its form of mounting in the valve which are required for the diaphragm to achieve precise and consistent valve-regulation in its interaction with the jet of gas from the control chamber in some respects conflict with those which are required for the diaphragm to achieve optimum response to the pressure changes caused by inhalation and exhalation. For example, to ensure consistent interaction with the gas jet over a long service life the diaphragm is desirably of relatively hard material which will not be distorted by the gas jet itself and which has sufficiently strong restorative characteristics to retain a critical placement of the diaphragm relative to the jet after each deflection. For optimum pressure response, however, the diaphragm is desirably adapted to flex to a greater extent than is consistent with optimum jet-interaction.

It is one of the objects of the present invention to provide a form of valve that may be used to avoid the above problems.

According to one aspect of the present invention there is provided a valve of the kind specified wherein the pressure-responsive member is coupled to a control member which is distinct from said pressure-responsive member and which lies in the path of the jet of gas vented from the control chamber via said orifice such that deflection of the pressure-responsive member moves said control member towards or away from said orifice so as to change gas flow through the valve.

With a valve according to the invention it is readily possible to provide the pressure-responsive member (e.g. diaphragm) in a form and with a mounting that are optimum for the achievement of the desired pressure-response characteristics. The degree of rigidity and resilience in general required for interaction with the jet of gas vented from the control chamber is no longer required of the pressure-responsive member itself, but rather can be exhibited by, or conferred upon, the separate control member. Thus the valve of the present invention allows considerable freedom of design choice in ensuring optimum, precise and consistent operation of the valve.

The said control member may be pivoted, preferably in a flexural pivot so as to reduce friction and backlash, pivotting of the said member being of especial advantage in that it readily allows for wide choice in the amplification or attenuation appropriate to conversion of the deflection of the pressure-responsive member into movement of the control member with respect to the control-chamber jet.

A valve according to the invention is of especial advantage in the provision of a demand valve for use in breathing apparatus, and in a second aspect the invention resides in breathing apparatus in which a valve according to the first-defined aspect of the invention is adapted to control the admission of breathing gas from a pressurized supply thereof to a facemask, mouthpiece or other breathing interface means in response to pressure changes caused by the respiration of a user of the apparatus. However, valves in accordance with the invention may be utilized generally for gas flow regulation outside this field.

A demand valve for use in breathing apparatus in accordance with the present invention will now be more particularly described, by way of example, with reference to the accompanying drawings, in which.

Figure 1:
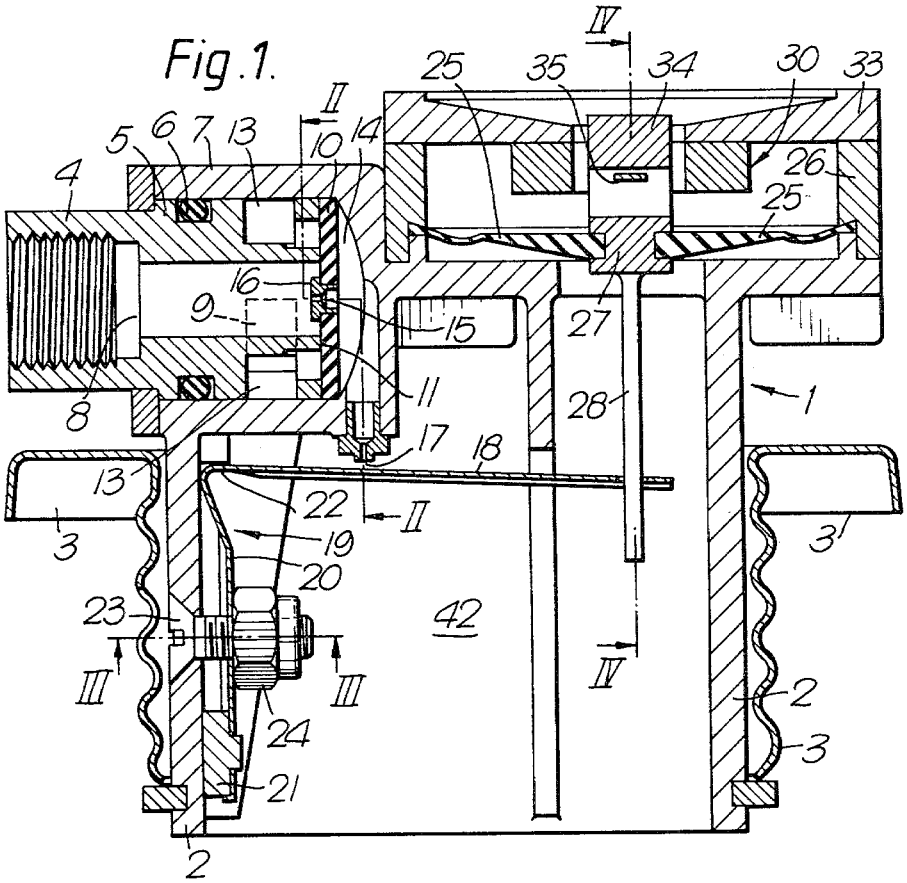
FIG. 1 is a sectional side elevation of the demand valve.
Figure 2:
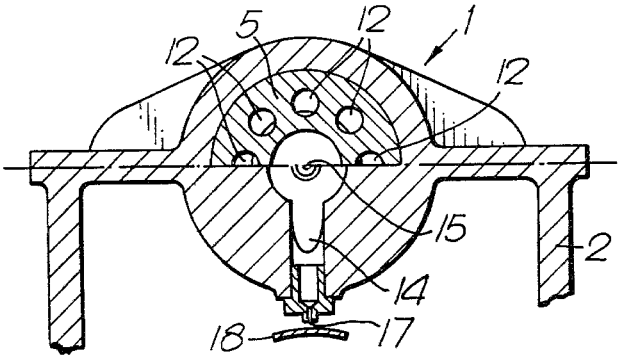
FIG. 2 is a sectional end view of part of the demand valve taken on line II—II of FIG. 1.
Figure 3:
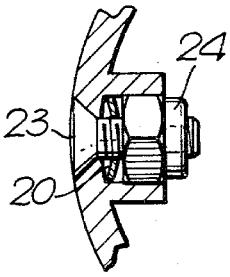
FIG. 3 is a sectional view of part of the demand valve taken on line III—III of FIG. 1.

Referring to FIGS. 1 to 3, the demand valve has a casing 1 of plastics or metal that includes a cup-shaped body part 2 for coupling the valve into the mask of a breathing apparatus. A threaded-ring 3 for securing the casing 1 to the mask encircles the part 2, and a source of gas of virtually constant pressure for supplying the breathing needs of the mask wearer is coupled to an internally-threaded union 4 of the valve. The union 4 is formed at the outer end of a cylindrical metal insert 5 that is retained, with a gas-tight seal provided by an O-ring 6, within a tubular portion 7 of the casing 1. Gas supplied to the union 4 enters a central bore 8 of the insert 5, and admission of this gas to the part 2 via two ports 9 in the wall of the portion 7, and thence into the mask, is regulated by an elastomeric disc 10.

The disc 10 is located against the flat inner end-face 11 of the insert 5 within the tubular portion 7 of the casing 1. Eight equally-spaced apertures 12 drilled into the face 11 encircle the bore 8 at that end, and open into an external annular groove 13 of the insert 5. Deflection of the disc 10 to lift it off its seating on the face 11 allows gas to pass from the bore 8 into the groove 13 via the apertures 12, and thence via the ports 9 into the part 2 to the mask. Such deflection of the disc 10 to admit gas to the mask, and its return to its seating flat against the face 11 to block admission of gas again, is dependent on variation of a control pressure established in a small chamber 14 located behind the disc 10 within the portion 7. More particularly the disc 10 responds to the balance of difference of thrust between the pressure of the gas within the bore 8 acting on a central, limited region of one side of the disc 10, and the control pressure within the chamber 14 acting over the full area of the other side of the disc.

The control pressure is established by continuous leakage of gas from the bore 8 into the chamber 14 through a small aperture 15 in a central boss 16 in the disc 10, and is varied by regulating the venting of this gas from the chamber 14 via a small jet orifice 17. In the latter respect, an arm 18 of an L-shaped spring-metal strip 19 lies in the path of the jet of gas escaping from the orifice 17 such that pressure build up in the chamber 14 varies in dependence upon movement of the arm 18 towards or away from the orifice 17. When the spacing of the arm 18 from the orifice 17 is decreased, the back pressure acting in the chamber 14 on the disc 10 increases and so reduces or blocks entirely, flow of gas under the disc 10 and into the part 2. Increase of the spacing, on the other hand, relieves the pressure build up by increasing the venting from the chamber 14 via the orifice 17, so enabling or increasing flow of gas under the disc 10 and into the part 2.

The arm 18 is arranged for pivotal movement towards and away from the orifice 17, the other arm 20 of the L-shaped strip 19 being clamped within the part 2 against the resilient seating 21. The junction of the two arms abuts an internal shoulder 22 of the part 2 so as to establish at the shoulder 22 a point for flexural pivoting of the arm 18. The arm 18 is also biased resiliently with respect to the orifice 17, the magnitude of such bias being set by adjustment of a screw 23 which engages with a retained lock-nut 24; adjustment of the screw 23 varies the clamping pressure of the arm 20 upon its seating 21 and accordingly varies its angular lie with respect to the shoulder 22. The bias may in practice be set—and such setting will be assumed for ease of explanation, initially in the following description—to position the arm 18 just close enough to the orifice 17 against the force of the jet to ensure that gas flow under the disc 10 is blocked. Pivotal movement of the arm 18 from this position is regulated by an elastomeric diaphragm 25.

The diaphragm 25 is clamped to the casing 1 around its periphery under an external collar 26, to respond to the difference between the pressure in the chamber 42 defined within body part 2 and the ambient pressure to which the diaphragm is exposed on its side remote from the chamber 42. A coupling member 27 is secured centrally to the diaphragm and extends into the part 2 where it has a bifurcated end 28 (see also FIG. 4) which clips resiliently to the free end of the arm 18 so that deflection of the diaphragm 25 is communicated to the arm 18 for regulating admission of the breathing gas to the mask. Inhalation by the mask wearer reduces pressure within the chamber 42, and the consequent inward deflection of the diaphragm 25 pivots the arm 18 away from the orifice 17. This reduces the control pressure within the chamber 14 and so enables gas flow under the disc 10 into the chamber 42 via the ports 9 to meet the breathing needs of the mask wearer. When inhalation stops, return of the diaphragm 25 to its undeflected position moves the arm 18 back towards the orifice 17 and so shuts off gas flow into the mask. The mask will include provision for venting exhaled gas so that there is appropriate reduction in pressure, to draw the diaphragm 25 inwardly and supply fresh breathing gas through the demand valve, upon each inhalation.

Although the demand valve may be set to operate as described above in the "negative-pressure" mode—that is to say, normally closed and admitting gas only in response to inward deflection of the diaphragm 25 when a sub-ambient pressure is generated within the chamber 42—the construction incorporating the switch device, illustrated more particularly in FIGS. 4 to 7, is specially adapted for operation in a "positive-pressure" mode. That is to say it is arranged that the pressure within the mask and chamber 42 does not fall below the ambient pressure at any time during the respiratory cycle, thereby ensuring that any leakage from the mask (e.g. from an imperfect face seal) can only be in the outward direction and that there is no risk of contaminated or noxious gas being breathed in from the environment during use. For the "positive-pressure" mode, the screw 23 is set to bias the arm 18 a small distance away from the orifice 17 so that the valve normally admits gas to the mask and closes only in response to outward deflection of the diaphragm 25 upon pressure build-up from the admitted gas or from exhalation.

A consequence of "positive-pressure" operation of the valve is that when the associated mask is not actually being worn, i.e. so that the chamber 42 of the valve is effectively open to atmosphere, the valve will respond by opening fully under the biasing of the arm 18 and if the gas supply to the valve is turned on it will vent continuously through the valve and be wasted. The valve therefore incorporates a manually-operable switch device which can be actuated to selectively shut off gas flow through the valve irrespective of the pressure within the chamber 42.

Figure 4:
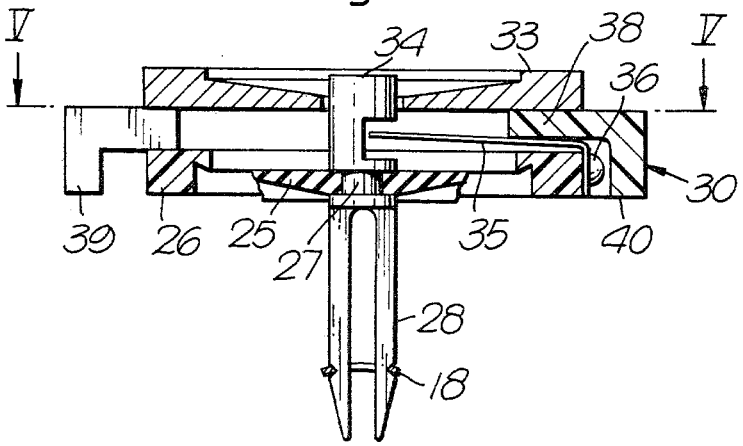
FIG. 4 is a sectional view of part of the demand valve and illustrating constructional features of a switch device incorporated in the demand valve, taken on line IV—IV of FIG. 1.
Figure 5:
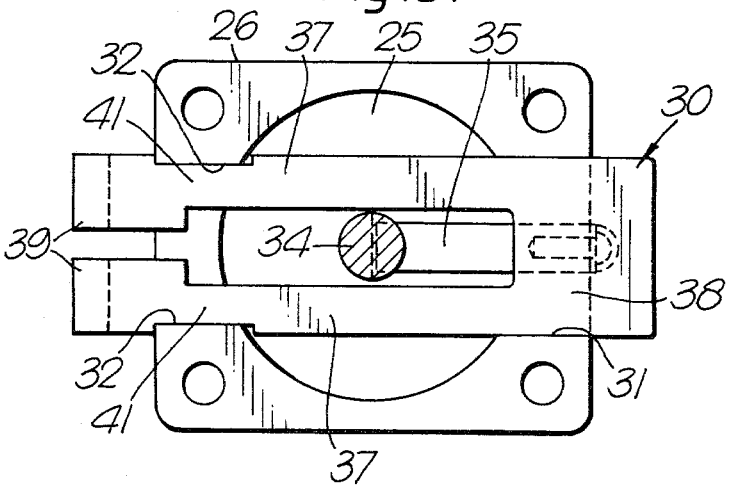
FIG. 5 is a plan view of the switch device taken on the line V—V of FIG. 4, the switch device being shown in FIGS. 4 and 5 in its normal unactuated position.
Figure 6:
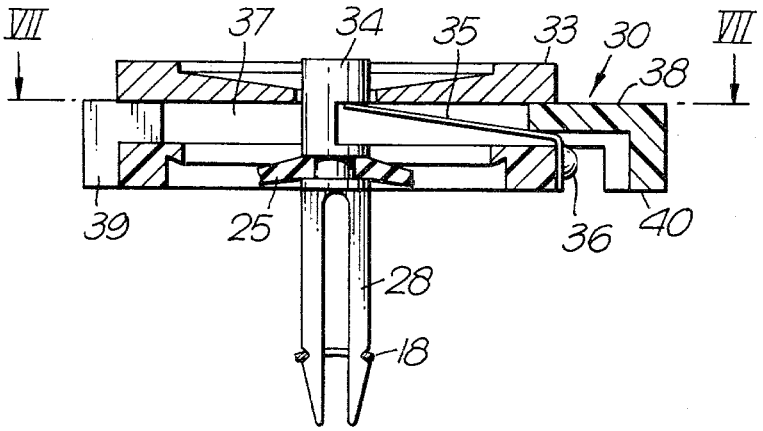
FIG. 6 is a sectional view corresponding to that of FIG. 4 but showing the switch device actuated.
Figure 7:
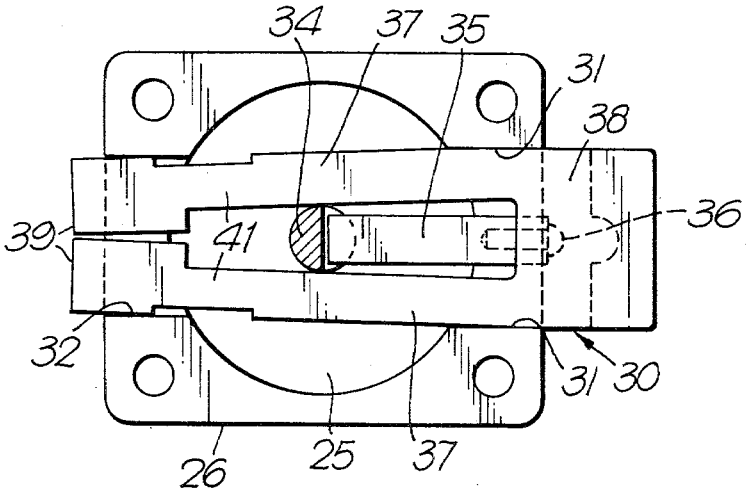
FIG. 7 is a plan view of the actuated switch device, taken on the line VII—VII of FIG. 6.

The switch device is normally set to an "ON" condition as illustrated in FIGS. 4 and 5 in which it has no effect on normal admission of gas in the "positive-pressure" mode, and can be readily actuated by the figures to an "OFF" condition as illustrated in FIGS. 6 and 7. Actuation of the switch device to its "OFF" condition lifts the member 27 to simulate outward deflection of the diaphragm 25 under pressure build-up in the chamber 42, and thereby bring the arm 18 close enough to the orifice 17 to block gas flow under the disc 10. To this end the switch device incorporates a slide 30 that extends transversely of the collar 26 in close fit within aligned slots 31 and 32 (FIGS. 5 and 7). The slide 30 is retained within the slots 31 and 32 by a cover-plate 33 that is apertured to give wide clearance to a button-extension 34 of the coupling member 27. This button-extension 34 is slotted to receive the free end of a spring-strip 35 which is clamped by a screw 36 to the outer wall of the collar 26 (the outer wall may be slotted to receive the strip 35 and screw 36), and which extends to the button-extension 34 through the slot 31, under the slide 30.

The slide 30 is of a resilient plastics material and is bifurcated to have two spring legs 37 extending from the head portion 38 of the slide 30 within the slot 31. The legs 37 pass on either side of the button-extension 34 into the slot 32, and terminate in down-turned finger-hold portions 39 projecting from the collar 26.

When the switch device is in the "ON" condition, illustrated in FIGS. 4 and 5, the slide 30 is withdrawn to a position in which the portions 39 project wholly from the collar 26. In this position a down-turned lip 40 of the head portion 38 abuts the outer wall of the collar 26, and externally-waisted sections 41 of the two legs 37 engage with the walls of the narrower—slot 32—of the two slots 31 and 32. A major part of the length of the head portion 38 now overlies the spring-strip 35 holding it down and out of engagement with the slotted button extension 34, the slot in the button-extension being of sufficient depth to permit the full operational range of flexure of the diaphragm 25 to take place without the button-extension coming into contact with the strip 35 in this condition of the switch. The slide 30 is locked in this position by virtue of the engagement of the waisted sections 41 of the legs 37 with the slot 32. This engagement can be broken only by squeezing the finger-hold portions 39 in towards one another against the resilient bias of the legs 37 outwardly from one another.

Squeezing the finger-hold portions 39 in towards one another disengages the waisted sections 41 from the slot 32 and allows the slide 30 to be pushed from that end lengthwise of the slots 31 to 32, until the portions 39 themselves abut the outer wall of the collar 26. This moves the head portion 38 from its obstruction of the spring-strip 35, thereby allowing the strip 35 to engage and act upon the button-extension 34. Such action upon the button-extension 34 lifts the member 27 against the bias of the arm 18 to close the valve and shut off admission of gas to the mask. The slide 30 is retained in this position to maintain the valve closed and the admission of gas shut off, by virtue of the outward bias of the legs 37 on the walls of the slot 32.

The switch device may be returned from its "OFF" condition illustrated in FIGS. 6 and 7, to its normal, locked "ON" condition illustrated in FIGS. 4 and 5, simply by pulling the finger-hold portions 39 away from the outer wall of the collar 26. This causes the head portion 38 of the slide 30 to obstruct the spring-strip 35 again and disengage it from the button-extension 34. However while the switch device is in the "OFF" condition, its action blocking gas admission can be overriden temporarily, e.g. for test or emergency purposes, simply by applying finger pressure to the button-extension 34 to depress the member 27 against the action of the spring-strip 35 and, depending upon the extent of depression, against the action of the arm 18 also. Release of such pressure restores the shut-off state appropriate to the "OFF" condition of the switch device.

The arm 18 (and the arm 20 also) of the spring 19 is curved transversely of its width so as to increase rigidity and more precisely isolate pivotting to the shoulder 22. Such curvature of the arm 18, being convex in relation to the orifice 17, is also believed to have advantage in requiring less thrust for movement of the arm 18 against the force of the gas jet from the chamber 14; a flat surface exposed to the jet has also been found acceptable but a concave surface unacceptable. The orifice 17 may for convenience be provided by a jet-nozzle insert as illustrated, but may alternatively be simply a drilling.

The diameter of the orifice 17 may be for example, 0.02 millimeters, and that of the aperture 15, 0.15 millimeters.

In other embodiments of the valve there may be a simple adjustment mechanism for changing selectively the mode of operation of the valve. More particularly such mechanism may be coupled to the diaphragm 25 to impose an adjustable spring loading (inwardly, outwardly or either selectively) such that the valve operates to open in response to pressure increase or decrease on one side or other of the diaphragm. Such mechanism, which may be adjustable to the extent necessary to shut off or open the valve completely at the wish of the user, may consist simply of a ring that carries a spring for engaging with an outward extension from the member 27 and can be screwed into or out of the collar 26 for varying the loading on the diaphragm 25 and arm 18.

The valve of the present invention is applicable other than as a demand valve. More especially the valve may be used as a pressure-reducing valve; in the context of the construction of valve described above, stronger springing of the arm 18 or use of a spring over the top of the diaphragm 25 would normally be required to establish the reduced-pressure level. Since a reasonably constant input pressure to the valve is desirable, its application to pressure reduction would normally be as a second stage reducer.

I claim:

1. A breathing gas demand valve comprising means defining an inlet chamber for receiving gas from a breathing gas supply; means defining an outlet chamber for delivering gas to breathing interface means; valve means provided in the gas flowpath between said inlet and outlet chambers and constructed and arranged to control the main gas flow through the valve from the inlet chamber to the outlet chamber; means defining a control chamber adapted to have a gas pressure therein; said valve means being responsive to the gas pressure in said control chamber whereby said main gas flow is controlled by said valve means responsive to the gas pressure in the control chamber; an inlet orifice connecting the control chamber with the inlet chamber and through which gas is substantially continuously bled from the inlet chamber to the control chamber; an outlet orifice connecting the control chamber with the outlet chamber and through which a jet of gas is substantially continuously vented from the control chamber into the outlet chamber; a pressure-responsive member bounding on one side thereof the outlet chamber and exposed on the other side to a reference pressure, said pressure-responsive member being constructed and arranged to deflect in response to pressure changes within the outlet chamber consequent to the respiration of a user of the valve; and a control member which is distinct from but coupled to said pressure-responsive member, and located within the outlet chamber; the control member comprising a two-armed, spring element a first arm of which is held firmly to a fixed part of the valve structure and the second arm of which is coupled to the pressure-responsive member with a portion of the second arm lying adjacent to the outlet orifice in the path of the jet of gas vented from the control chamber through the outlet orifice; the second arm of the control member being deflectable relative to the first arm about a flexural pivot established in said control member and arranged to deflect with deflection of the pressure-responsive member to move the said portion of said second arm towards or away from the outlet orifice in dependence upon pressure changes within said outlet chamber, thereby to control the rate of venting of gas from the control chamber and thereby the gas pressure within said control chamber; the control member being so constructed and arranged that the aforesaid movement of said portion of the second arm thereof controls the rate of venting of gas from the control chamber by variable interaction with said jet and is arranged to establish such gas pressure in the control chamber as to shut off the main gas flow through the valve without said portion of said second arm seating physically over said outlet orifice; the control member being self-biasing, resiliently, towards a position in which said portion of the second arm thereof is at a set spacing from said outlet orifice; and means associated with said first arm and said valve structure for applying a variable force to a portion of said first arm to vary said set spacing between said portion of said second arm and said outlet orifice.

2. A valve according to claim 1 wherein said outlet chamber is bounded in part by a pressure-responsive diaphragm and bounded in part by a tubular housing provided with means for the physical connection thereof to breathing interface means, the control member being located within said tubular housing; the axis of said diaphragm being generally parallel to the axis of said housing; the axis of said outlet orifice from the control chamber being generally parallel to the axis of said housing; and the axis of said inlet chamber being generally perpendicular to the axis of said housing.

3. A valve according to claim 2 comprising a unitary body member defining said tubular housing and a second tubular housing generally perpendicular to the first-mentioned tubular housing; an insert received within said second tubular housing and defining said inlet chamber; and a flexible valve disc received within said second tubular housing and separating the inlet chamber from an end of that housing; the space between the valve disc and said end of the second tubular housing defining the control chamber.

4. A valve according to claim 1 wherein the jet of gas vented from the control chamber impinges upon said second arm of the control member at a location intermediate the pivot and the point of coupling of the control member to the pressure-responsive member.

5. A valve to claim 1 wherein the control member is biased resiliently to a first position in which the spacing between said portion of said second arm and said outlet orifice is such that said main gas flow through the valve is permitted.

6. A valve according to claim 5 comprising a switch device which is selectively actuable to move the control member to a second position in which the spacing between said portion of said second arm and said outlet orifice is such that said main gas flow through the valve is prevented.

7. A valve according to claim 6 wherein the switch device comprises spring means, in a first operative condition of the device the resilient bias of said spring means being transmitted to the control member in opposition to the first-mentioned resilient bias so as to move the control member to said second position, and in a second operative condition of the device the transmission of the resilient bias of said spring means to the control member being prevented.

8. A valve according to claim 7 wherein there is a coupling member for coupling said pressure-responsive member to said control member, wherein in said first operative condition of said switch device the resilient bias of said spring means is transmitted to said control member by contact of the spring means with said coupling member, and wherein said coupling member can be manipulated at the selection of a user of the valve to override the resilient bias of said spring means and thereby permit said main gas flow through the valve.

9. A valve according to claim 9 wherein a portion of said coupling member is accessible for manipulation on that side of the pressure-responsive member and switch device remote from said outlet chamber.

10. A valve according to claim 6 wherein the action of said switch device preventing said main gas flow through the valve can be overriden at the selection of a user of the valve. pg,21

11. A valve according to claim 6 wherein the said switch device is located on that side of the pressure-responsive member remote from said outlet chamber.

* * * * *